US005762261A

United States Patent [19]

Okabe et al.

[11] Patent Number: 5,762,261

[45] Date of Patent: Jun. 9, 1998

[54] COLLAPSIBLE CONTAINER

[75] Inventors: Masaaki Okabe; Katsuji Takayama, both of Nagoya; Mitsuru Nakamura, Suzuka, all of Japan

[73] Assignee: Asano Danbohru Kabushikikaisha, Aichi-ken, Japan

[21] Appl. No.: 822,904

[22] Filed: Mar. 24, 1997

[30] Foreign Application Priority Data

Mar. 22, 1996 [JP] Japan ..... 8-093188

[51] Int. Cl.[6] ..... B65D 5/36

[52] U.S. Cl. ..... 209/117.08; 229/23 A; 229/117.04; 229/179; 229/199

[58] Field of Search ..... 229/23 A, 117.04, 229/117.07, 117.08, 178, 179, 199

[56] References Cited

U.S. PATENT DOCUMENTS

| | | | |
|---|---|---|---|
| 1,850,164 | 3/1932 | Andrews | 229/199 |
| 1,911,952 | 5/1933 | Halladay | 229/117.08 |
| 1,971,863 | 8/1934 | Lupton | 229/199 |
| 2,698,126 | 12/1954 | Belsinger | 229/179 |
| 2,914,236 | 11/1959 | Shapiro | 229/117.04 |
| 4,331,231 | 5/1982 | Boyle | 206/45.25 |
| 4,702,409 | 10/1987 | Osborne | 229/125 |
| 5,421,509 | 6/1995 | Thuin et al. | 229/117.07 |

FOREIGN PATENT DOCUMENTS

| | | | |
|---|---|---|---|
| 0 393 253 A1 | 10/1990 | European Pat. Off. . | |
| 3932235 | 4/1990 | Germany | 229/117.08 |
| 593373 | 10/1947 | United Kingdom . | |
| 653992 | 5/1951 | United Kingdom . | |
| 971272 | 9/1964 | United Kingdom . | |

*Primary Examiner*—Gary E. Elkins

*Attorney, Agent, or Firm*—Armstrong, Westerman, Hattori, McLeland & Naughton

[57] ABSTRACT

A collapsible container is provided which can be folded extremely simply and in which a bottom board portion and/or side board portions are not bent easily in use. The collapsible container includes a bottom board portion constituted by one flat sheet board portion. A pair of first side board portions are connected to the bottom board portion so as to extend in a first direction and so as to be opposite to each other. A pair of second side board portions are connected to the bottom board portion so as to extend in a direction perpendicular to the first direction and so as to be opposite to each other. The collapsible container also includes a folding mechanism which may include creases formed on each of the pair of first side board portions so as to extend from a substantially center portion of an upper side of the first side board portion to opposite ends of a lower side of the first side board portion on the bottom board portion side. The collapsible container preferably also includes a pair of side board reinforcing portions. Each of the side board reinforcing portions is provided so as to be connected to the center portion of the upper side of each of the first side board portions between two points where the creases intersect the upper side so that the side board reinforcing portion can be folded to the inside of the first side board portion and can be fitted between the second side board portions.

3 Claims, 6 Drawing Sheets

COLLAPSIBLE CONTAINER

BACKGROUND OF THE INVENTION

1. Field of the Invention

The present invention relates to collapsible containers, and particularly to a collapsible container having a high load-withstanding ability.

2. Description of the Related Art

Conventionally, various collapsible containers made from corrugated board materials, synthetic resin materials, and so on, have been developed in order to reduce a space for storage not in use or for storage for sending back after use.

For example, with respect to such a collapsible container, there is known an invention disclosed in JP-A-8-58766.

Referring to FIG. 6, a basic structure of a prior art will be described below. In FIG. 6, two bottom base boards 32 and 32 are put side by side, and the inside ends of the two bottom base boards 32 and 32 are connected in the longitudinal direction by hinge tape to thereby provide a bottom board 30, so that the bottom board 30 can be folded in two with the inside ends of the two bottom base boards 32 and 32 as a border.

First side boards 34 and 34 are erected at creases formed as boarders on the laterally opposite sides of the bottom board 30, so that the first side boards 34 and 34 can be folded through the creases.

On the other hand, second side boards 36 and 36 are connected between the first side boards 34 and 34 through creases as borders respectively so that the second side boards 36 and 36 can be folded at the creases respectively.

In addition, reinforcing pieces 38 and 38 are connected to these second side boards 36 and 36 at their ends on the bottom board 30 side through creases as borders so that the reinforcing pieces 38 and 38 can be folded at the creases respectively, and if the reinforcing pieces 38 and 38 are bent perpendicularly to the second side boards 36 and 36 respectively, the reinforcing pieces 38 and 38 can be stacked on the bottom board 30.

Further, at the respective center portions of the second side boards 36 and 36 and the reinforcing pieces 38 and 38, creases are provided on the extension of the respective inside ends of the two bottom base boards 32 and 32 constituting the bottom board 30, so that each of the second side boards 36 and 36 and each of the reinforcing pieces 38 and 38 can be folded into two. Thus, the bottom board 30, the first side boards 34 and 34, the second side boards 36 and 36 and the reinforcing pieces 38 and 38 are provided so as to be foldable so that the container is made to be not bulky by folding into two when it is not in use.

There is however such a problem as follows. That is, when articles to be packed are accommodated in the container, the bottom board 30 is apt to be folded to have a V-shaped section with the respective inside ends of the two bottom base boards 32 and 32 as a border upon reception of the articles as a load, and in addition the second side boards 36 and 36 and the reinforcing pieces 38 and 38 are apt to be folded with their creases as borders. As a result, the container cannot keep its assembled shape so that the packed articles are apt to be scattered or damaged.

It is an object of the present invention to solve the foregoing problems in the conventional technique.

It is another object of the present invention to provide a collapsible container in which a bottom board portion and/or side board portions are not bent easily in use.

It is a further object of the present invention to provide a collapsible container in which a bottom board portion and/or side board portions are not bent in use, while the container can be folded extremely easily when it is to be folded.

SUMMARY OF THE INVENTION

In order to achieve the above objects, according to an aspect of the present invention, provided is a collapsible container which comprises: a bottom board portion; a pair of first side board portions connected to the bottom board portion so as to extend in a first direction and so as to be opposite to each other; a pair of second side board portions connected to the bottom board portion so as to extend in a direction perpendicular to the first direction and so as to be opposite to each other; and a folding mechanism; wherein the bottom board portion is constituted by one flat sheet board portion.

In the above collapsible container, preferably, the folding mechanism includes creases formed on each of the pair of first side board portions so as to extend from a substantially center portion of an upper side of the first side board portion to opposite ends of a lower side of the first side board portion on the bottom board portion side.

When the container is not in use, the respective portions outside the creases of the first side board portions are folded to the inside of the container together with the second side board portions along the creases. Because the first side board portions and the second side board portions are connected to each other, when the second side board portions are pushed inside the container, the portions outside the creases of the first side board portions are folded inward together the second side board portions. At the same time the portions inside the creases of the first side board portions are folded to the outside of the container as if they are pushed down.

It is therefore not necessary to perform a troublesome work such as removing some portion of the container when the container is to be folded.

In the above collapsible container, preferably, the container further comprises a pair of side board reinforcing portions each of which is provided so as to be connected to the center portion of the upper side of each of the first side board portions between two points where the creases intersect the upper side so that the side board reinforcing portion can be folded to the inside of the first side board portion and can be fitted between the second side board portions.

Being almost fitted between the second side board portions, the side board reinforcing portions keep the second side board portions standing from the inside of the container so that the respective second side board portions are prevented from falling down to the inside of the container.

Preferably, in the above collapsible container, fitting portions are provided on opposite sides of each of the side board reinforcing portions, and fitting slots to which the fitting portions of the side board reinforcing portion are to be fitted are provided in side end portions of the pair of second side board portions adjacent to the first side board portions respectively.

The fitting slots provided in the second side boards are disposed in the side ends which become borders with the first side board portions respectively in order to fit the side board reinforcing portions in tight contact with the first side board portions.

Preferably, in the above collapsible container, an irrelevant movement preventing board which can be almost fitted to an opening of a container body is provided on a back of the bottom board portion.

DETAILED DESCRIPTION OF THE PREFERRED EMBODIMENT

An embodiment of the present invention will be described with reference to the drawings.

Figure 1:
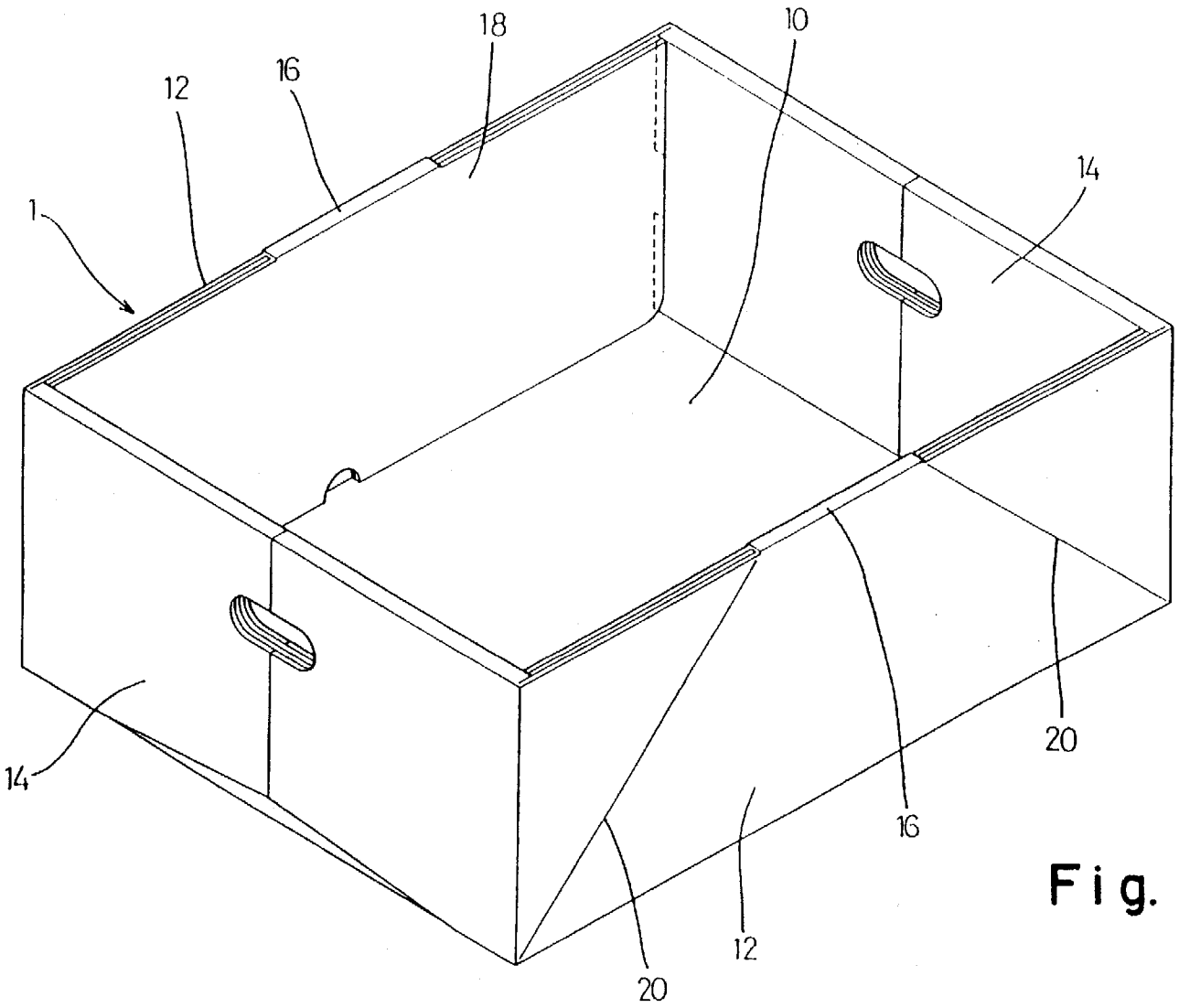
FIG. 1 is a perspective view of the collapsible container according to the present invention in a state where it has been assembled.

FIG. 1 is a perspective view illustrating an embodiment of the collapsible container according to the present invention.

As shown in FIG. 1, a container 1 has a bottom board portion 10, first side board portions 12 extending in a first direction (the longitudinal direction of the container) so as to be opposite to each other, second side board portions 14 extending in the direction perpendicular to the first direction (the lateral direction of the container) so as to be opposite to each other, and side board reinforcing portions 18.

Figure 4:
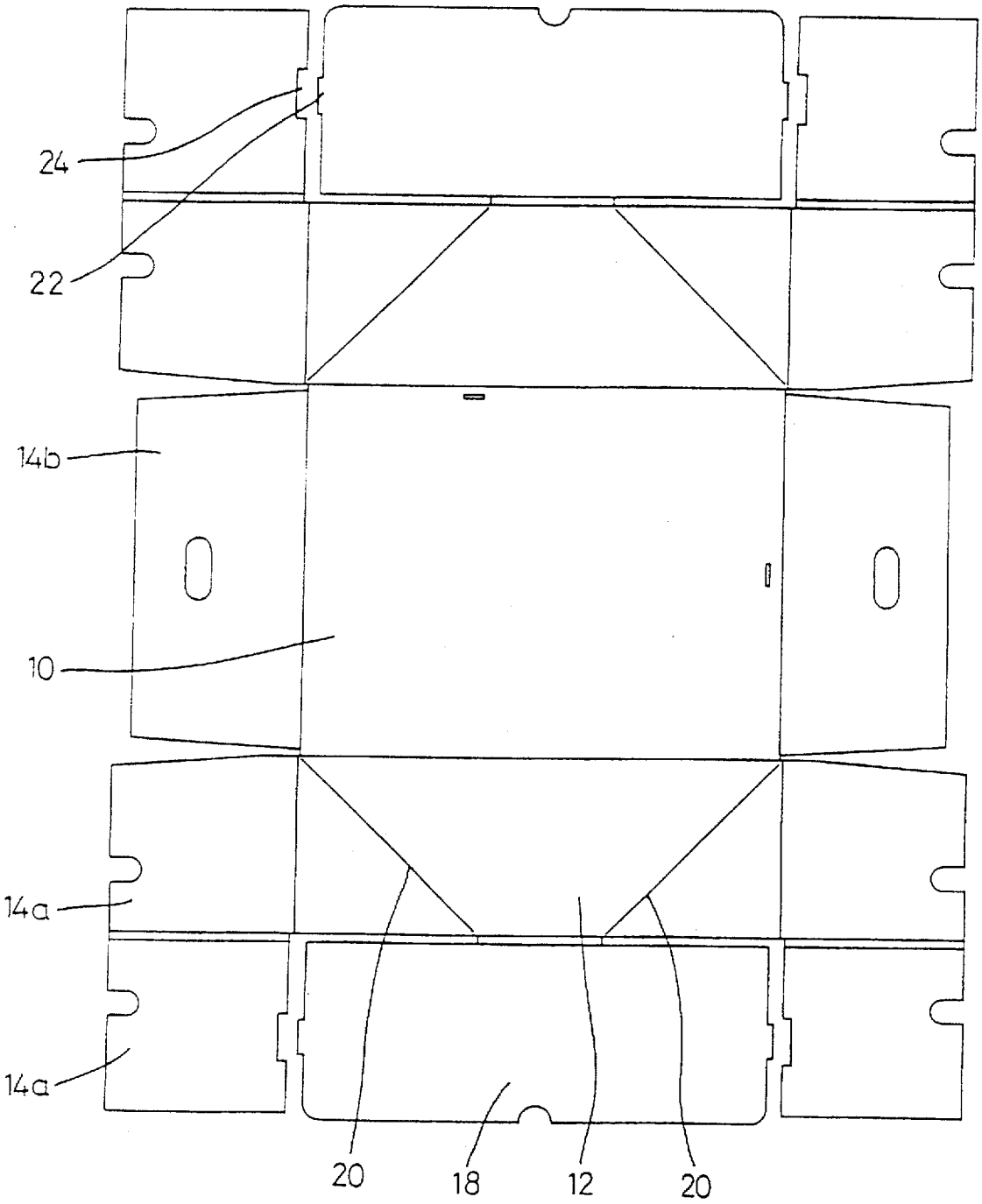
FIG. 4 is a development of the collapsible container according to the present invention.

This container is formed of a sheet of corrugated board which is cut and assembled in accordance with such a development as shown in FIG. 4. The material is not limited to the corrugated board, but it may be synthetic resin or the like so long as it is easy to worked.

The bottom board portion 10 is made of a creaseless, flat and rectangular sheet portion of corrugated board. Therefore the bottom board portion 10 is not easily bent by the load of packed articles when the container is in use.

Figure 3:
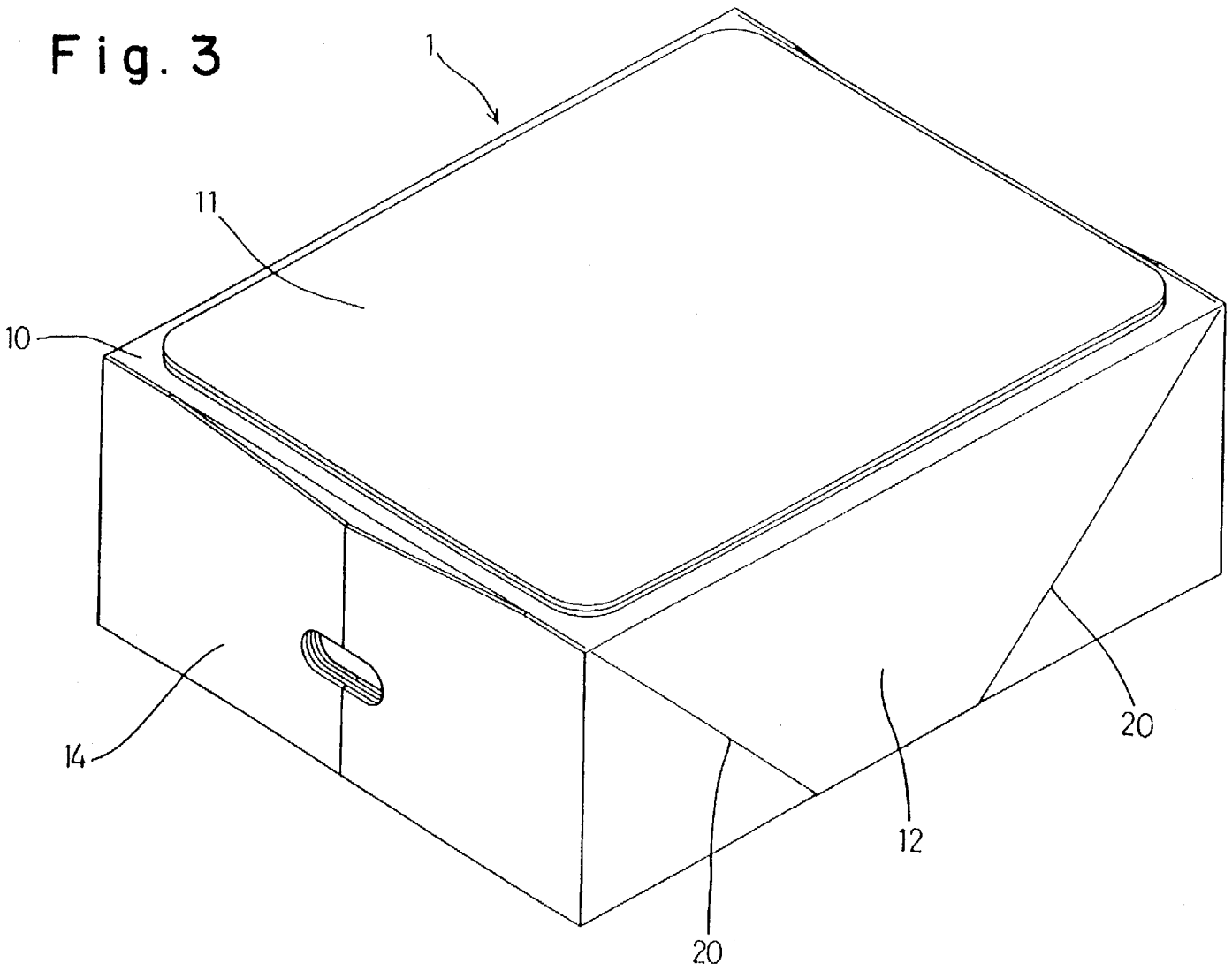
FIG. 3 is a perspective view of the collapsible container according to the present invention when it is viewed from the back side.

In this embodiment, an irrelevant movement preventing board 11 also formed of a creaseless and flat sheet of corrugated board is provided on the back side of the bottom board portion 10 as shown in FIG. 3 so as to reinforce the bottom board portion 10 to thereby make the bottom board portion 10 more difficult to be bent.

The first side board portions 12, the second side board portions 14 and the side board reinforcing portions 18 are also made rectangular.

In the first side board portions 12, creases 20 are formed so as to extend from the opposite ends of connection portions 16 between the first side board portions 12 and the side board reinforcing portions 18 to the opposite ends of the first side board portions 12 on the bottom board portion 10 side, respectively.

The second side board portions 14 are formed so as be connected to the first side board portions 12 respectively.

Figure 2:
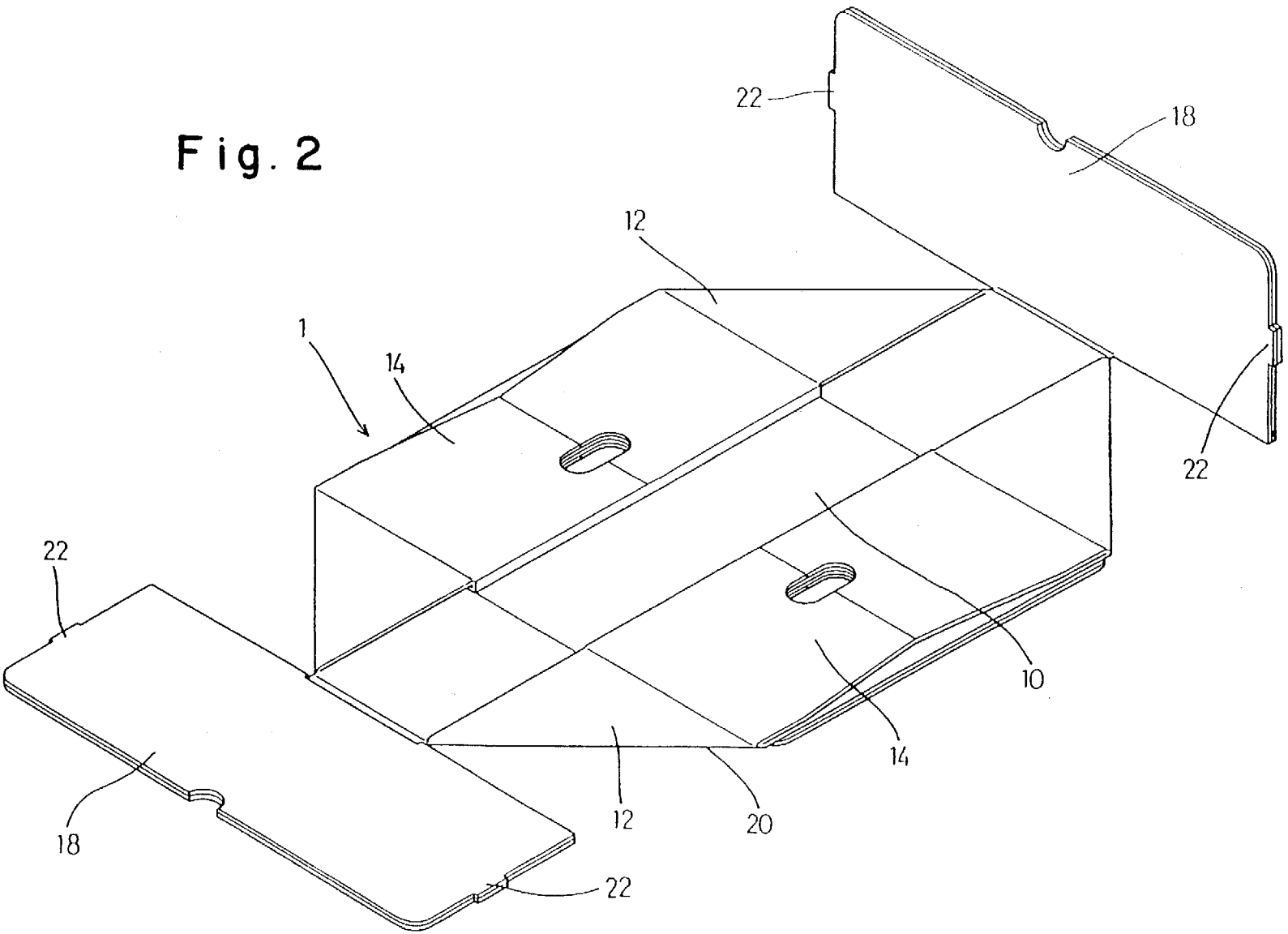
FIG. 2 is a perspective view of the collapsible container according to the present invention in a state where it is folded.

Therefore, if the second side board portions 14 are folded toward the inside of the container, the portions outside the creases of the first side board portions 12 operate together with the second side board portions 14 so as to be folded toward the inside of the container due to the presence of the creases respectively, and at the same time the portions inside the creases of the first side board portions 12 are folded toward the outside of the container (see FIG. 2).

Such a series of folding operations are performed in the same manner even in the case where the side board reinforcing portions 18 are not provided.

In addition, fitting slots 24 are formed in the second side board portions 14 at opposite end portions in the longitudinal direction of the container as will be described later so that fitting portions 22 provided on the side board reinforcing portions 18 as will be described later can be fitted into the fitting slots 24, respectively.

In addition, hook holes for detaching the fitted side board reinforcing portions 18 are formed in the side board reinforcing portions 18 respectively.

The side board reinforcing portions 18 are provided above the first side board portions 12 through the connection portions 16 respectively.

These side board reinforcing portions 18 are folded toward the inside of the container, and fitted between the second side board portions 14 respectively when the container is to be used.

By this configuration, the second side board portions 14 can be prevented from being folded to the inside of the container when the container is in use.

The width of the respective side board reinforcing portions 18 in the lateral direction thereof is made to be equal to the height of the respective first side board portions 12, so that the side board reinforcing portions 18 contact with the second side board portions 14 over the entire width of the respective second side board portions 14 in the lateral direction thereof when the side board reinforcing portions 18 are folded toward the inside of the container.

This configuration surely prevents the second side board portions 14 from being folded to the inside of the container.

The fitting portions 22 are provided on each of the side board reinforcing portions 18 at the longitudinally opposite ends thereof. The fitting portions 22 are fitted into the above-mentioned fitting slots 24 of the second side board portions 14 when the side board reinforcing portions 18 are folded to the inside of the container.

Referring to FIG. 3, the irrelevant movement preventing board 11 is provided on the back of the bottom board portion 10.

The irrelevant movement preventing board 11 is made a little shorter and narrower than the bottom board portion 10.

Therefore, when a container is laid on the top of another container in use, the irrelevant movement preventing board 11 of the first-mentioned container is almost fitted to an upper opening of the other container. For the purpose of prevention of irrelevant movement, the irrelevant movement preventing board is not always necessary to be a flat sheet of board, but four irrelevant movement preventing board pieces may be disposed at the four corner of the bottom board portion 10 so as to be almost fitted to the top opening of the container. However, when articles to be packed are heavy in weight, it is preferable to use one flat sheet of irrelevant movement preventing board in order to reinforce the bottom board portion 10.

FIG. 4 is a development of the container 1. The container 1 according to the present invention can be produced easily by cutting a sheet of corrugated board in accordance with the development.

Figure 5:
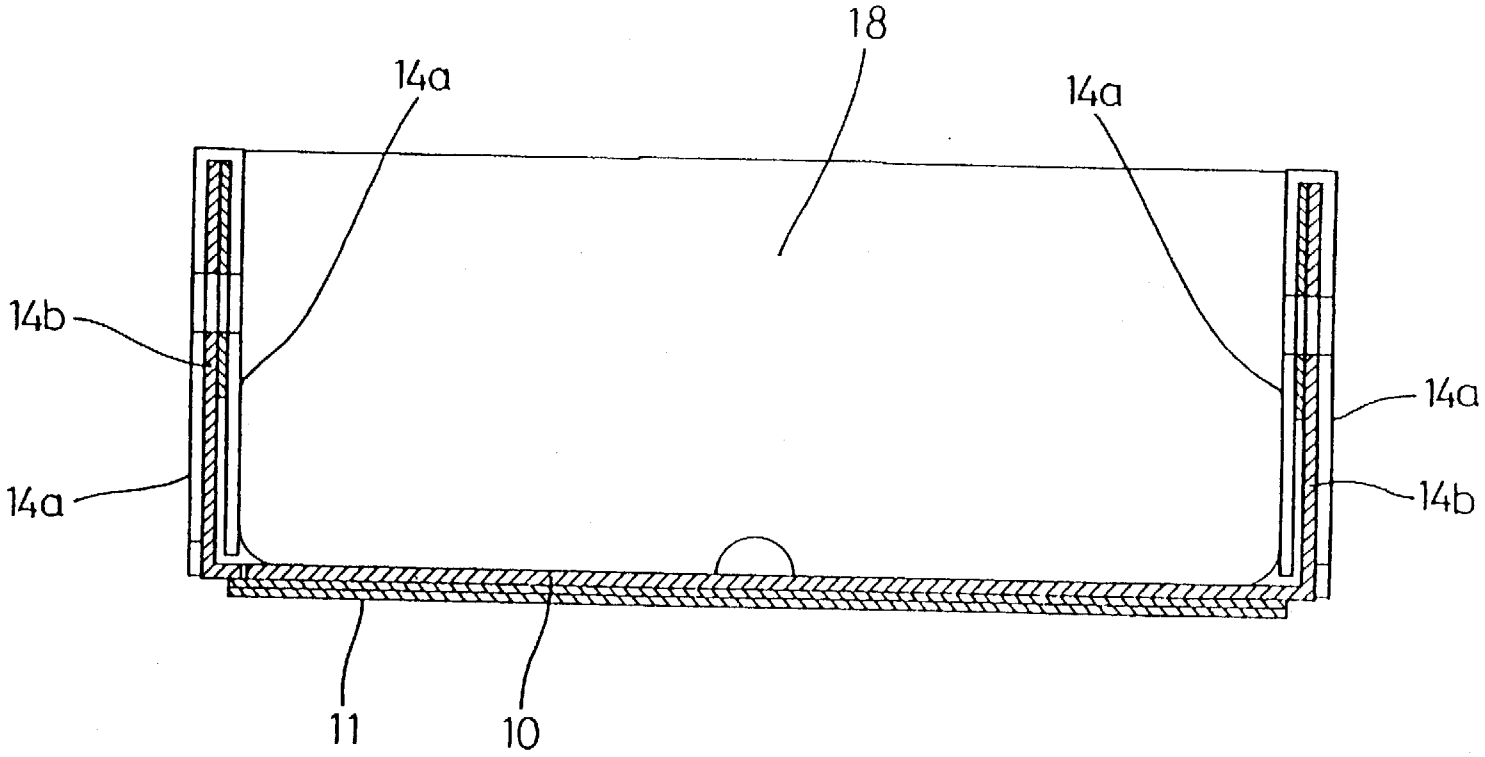
FIG. 5 is a section of the collapsible container according to the present invention at its longitudinally central portion.
Figure 6:
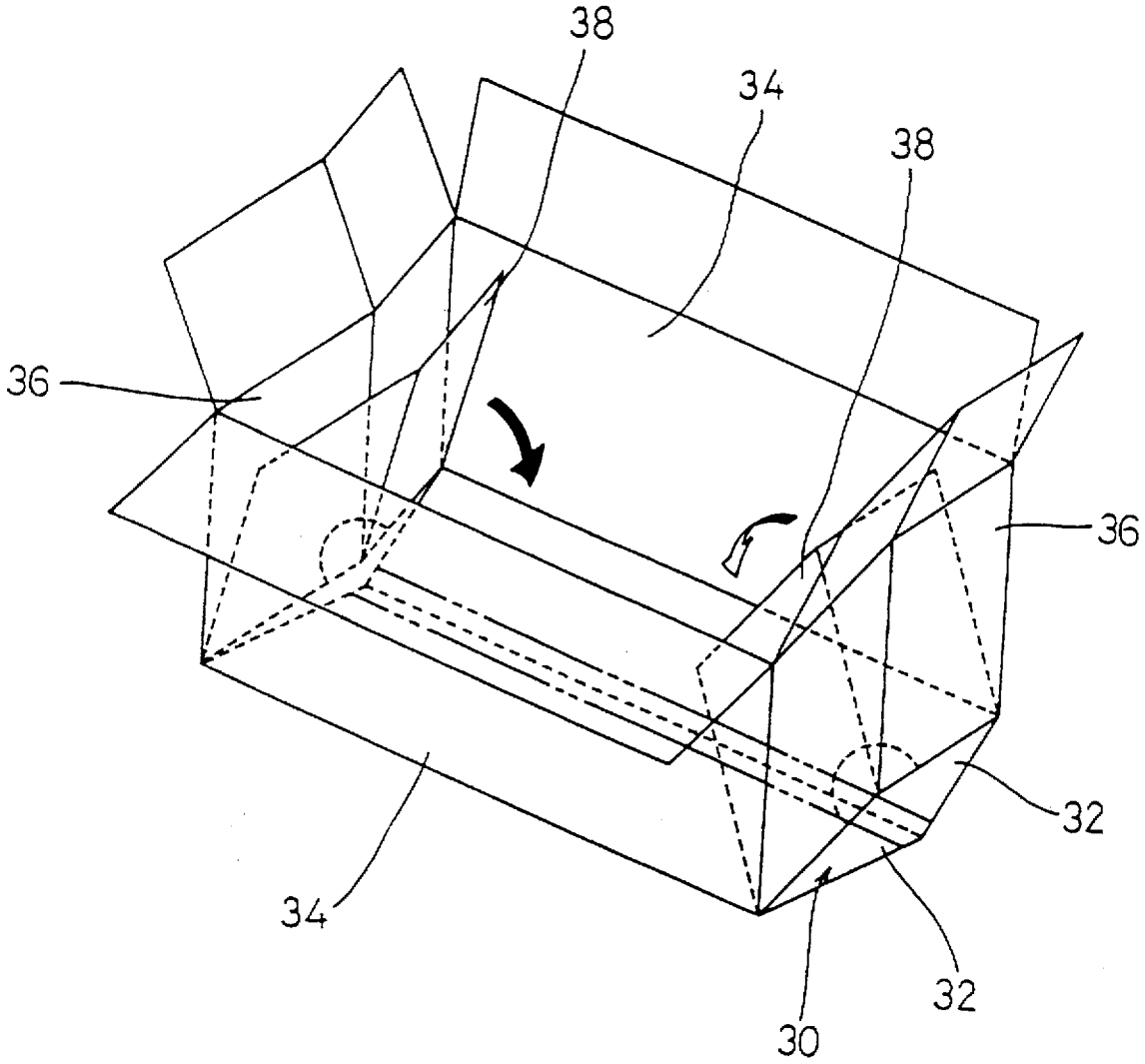
FIG. 6 is a perspective view of a conventional collapsible container.

In FIG. 4, two portions **14*a* are folded so that the folded portions 14*a* are put on the portions 14*b* so as to fixedly cover the latter from their end portions, thereby completing the container (see FIG. 5**).

The present invention is carried out in the above-mentioned manner, and has effects as follows.

By the provision of such a structure that a bottom portion of the collapsible container is made of a flat sheet of board portion, it is possible to prevent the bottom portion of the container from being bent easily upon reception of the load of articles to be packed.

In addition, by the provision of such a structure in which, of the two pair of side board portions opposite to each other and connected with to bottom board portion, the pair of first side board portions are provided with creases extending from the substantially center portions of the upper sides thereof to the opposite ends on the bottom board portion side so that the folding mechanism is constituted by the creases, it is possible to fold the container easily without removing any side board portions of the container.

Further, by the provision of such a structure that, at a portion between intersection points of the creases with the upper side of each of the first side board portions, a side board reinforcing portion which can be freely folded to the inside of the first side board portion and can be fitted between the second side board portions is provided, it is possible to prevent the second side board portions from falling down to the inside by the fitting of the side plate reinforcing portions to the second side board portions, so that in use there is no fear that the container is folded to break or scatter the packed articles even when vibrations are given to the container or even when the container is laid on the top of another container.

In addition, by the provision of such a structure that fitting portions are formed on the opposite sides of the respective side board reinforcing portions, and fitting slots to which the fitting portions of the side board reinforcing pieces are to be fitted are formed at the opposite side ends of the pair of second side board portions on the side of adjacent one of the first side board portions, it is easy to fit the side board reinforcing portions between the second side board portions, and it is possible to surely prevent the second side board portions from falling down into the inside.

In addition, by the provision of such a structure that an irrelevant movement preventing board is provided on the back of the bottom board portion of the container so that the irrelevant movement preventing board can be almost fitted into an opening portion of another container when the first mentioned container is laid on the top of the other container, the containers are almost fitted to each other so that horizontal irrelevant movement of the containers is prevented, and there is no fear that the stacked containers slide and fall down.

What is claimed is:

1. A collapsible container comprising:

a bottom board portion being constituted from one flat sheet;

a pair of first side board portions, wherein each first side board portion of said pair of first side board portions is perpendicularly connected to said bottom board portion so as to extend in a first direction and each first side board portion has an inner surface facing opposite to each other;

a pair of second side board portions, wherein each second side board portion of said pair of second side board portions is perpendicularly connected to said bottom board portion so as to extend in a direction perpendicular to said first direction and each second side board portion has an inner surface facing opposite to each other;

a folding mechanism, wherein said folding mechanism includes creases formed on each of said pair of first side board portions so as to extend from a substantially center portion of an upper side of said first side board portions to opposite ends of a lower side of said first side board portions on a side of said bottom board portion;

a pair of side board reinforcing portions each of which is connected to said center portion of said upper sides of each of said first side board portions between two points where said creases intersect said upper sides, said side board reinforcing portions being folded toward said inner surfaces of each of said first side board portions and being fitted between each of said second side board portions:

fitting portions provided on opposite sides of each of said side board reinforcing portions: and fitting slots to which said fitting portions of said side board reinforcing portions are to be fitted, said fitting slots provided in side end portions of said pair of second side board portions adjacent to said first side board portions, respectively.

2. The collapsible container according to claim 1, further comprising an irrelevant movement preventing board which is provided on a back of said bottom board portion.

3. The collapsible container according to claim 2, further comprising an opening of said container, wherein said irrelevant movement preventing board is shaped so as to be almost fitted in said opening of a body of said container.

* * * * *